US006414570B1

(12) United States Patent
Dalconzo et al.

(10) Patent No.: US 6,414,570 B1
(45) Date of Patent: Jul. 2, 2002

(54) LOW PROFILE, HIGH ISOLATION AND REJECTION X-BAND SWITCHED FILTER ASSEMBLY

(75) Inventors: Lawrence Dalconzo, Los Angeles; Robert C. Allison, Rancho Palos Verdes; Tamrat Akale, Torrance; James M. Harris, Encinitas; Herbert K. Jew, Gardena, all of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/588,087

(22) Filed: Jun. 6, 2000

(51) Int. Cl.[7] ..... H01P 1/20
(52) U.S. Cl. ..... 333/202; 333/205
(58) Field of Search ..... 333/202, 205, 333/203

(56) References Cited

U.S. PATENT DOCUMENTS 4,763,089 A * 8/1988 Pon ..... 333/202
6,094,588 A * 7/2000 Adam ..... 505/210
6,204,737 B1 * 3/2001 Ella ..... 333/187

* cited by examiner

*Primary Examiner*—Robert Pascal
*Assistant Examiner*—Joseph Chang
(74) *Attorney, Agent, or Firm*—Leonard A. Alkov; Glenn H. Lenzen, Jr.

(57) ABSTRACT

A multi-channel microwave switched filter bank, wherein the input circuitry and output circuitry are mounted on opposite sides of the filter bank, providing a compact structure with excellent isolation. The filter bank includes a set of microwave band pass filter circuits. A housing structure provides an outer conductive peripheral frame structure. A rack structure disposed within the housing structure has a plurality of elongated slots for mounting therein corresponding ones of the plurality of filter circuits. A top dielectric substrate board is mounted adjacent a first side of the rack structure and has a first set of openings formed therein for providing access to a first set of input/output (I/O) ports of the plurality of filter circuits. A bottom dielectric substrate board is mounted adjacent a second side of the rack structure opposite the first side and has a second set of openings formed therein for providing access to a second set of input/output (I/O) ports of the plurality of filter circuits.

12 Claims, 5 Drawing Sheets

LOW PROFILE, HIGH ISOLATION AND REJECTION X-BAND SWITCHED FILTER ASSEMBLY

TECHNICAL FIELD OF THE INVENTION

This invention relates to microwave devices, and more particularly to RF switched filter circuits.

BACKGROUND OF THE INVENTION

Microwave switched filter banks are used in some microwave applications, and provide the capability of selectively filtering an input RF signal with a desired filter characteristic. One exemplary filter assembly architecture places the set of band pass filters in one assembly, and positions the input switch circuitry on one side of the filter assembly, and the output switch circuit on the opposite side of the filter assembly, with the RF signals entering and leaving each of the switch circuitry and the filter bank in alignment with a single axis. While this architecture provides relatively high isolation between the input switch circuitry and the output switch circuitry, it is not a compact architecture, and requires additional space or volume.

Another filter assembly architecture places the input switch circuitry and the output switch circuitry on the same side of the band pass filter bank, but with the RF signals entering the input switch circuitry and exiting the output switch circuitry along one axis, which RF signals are passed between the input circuitry and the filter bank, and between the filter bank and the output circuitry, along a second axis orthogonal to the first axis. This alternate architecture is compact, but provides relatively low isolation between the input switch circuitry and the output switch circuitry since both are disposed on the same side of the filter bank.

SUMMARY OF THE INVENTION

A multi-channel microwave switched filter bank is described, wherein the input circuitry and output circuitry are mounted on opposite sides of the filter bank, providing a compact structure with excellent isolation.

In a preferred embodiment, the filter bank includes a plurality of microwave band pass filter circuits. A housing structure provides an outer conductive peripheral frame structure. A rack structure has a plurality of elongated slots for mounting therein corresponding ones of the plurality of filter circuits. The rack structure is disposed within the housing structure. A top dielectric substrate board is mounted adjacent a first side of the rack structure and has a first set of openings formed therein for providing access to a first set of input/output (I/O) ports of the plurality of filter circuits. A bottom dielectric substrate board is mounted adjacent a second side of the rack structure opposite the first side and has a second set of openings formed therein for providing access to a second set of input/output (I/O) ports of the plurality of filter circuits. A first switch circuit is mounted to the top dielectric substrate board for selecting one or more filter channels for connection to a first RF transmission line. A second switch circuit is mounted to the bottom dielectric substrate board for selecting one or more filter channels for connection to a second RF transmission line.

BRIEF DESCRIPTION OF DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
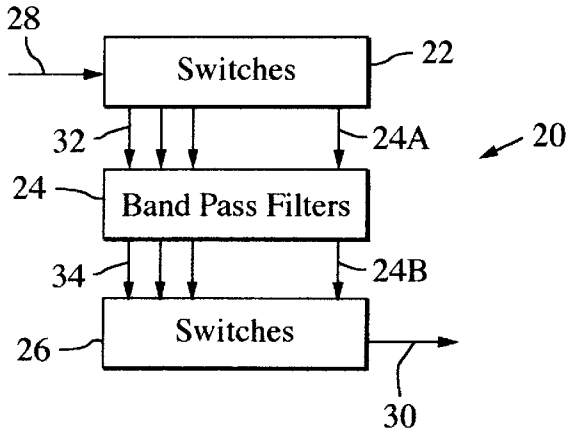
FIG. 1 is a simplified schematic block diagram of a switched filter bank architecture in accordance with an aspect of the invention.

A compact, high isolation switched filter assembly is provided by a new filter assembly architecture in accordance with an aspect of this invention. The filter assembly 20 includes an input switch circuitry 22, a band pass filter bank assembly 24 and an output switch circuitry 26. The filter bank assembly 24 is a relatively thin structure with an upper side 24A and a lower side 24B. The input switch circuitry 22 is disposed adjacent the upper side of the filter assembly, and the output switch circuitry 26 is disposed adjacent the lower side of the filter assembly. An input RF signal is input to the input switch circuitry on transmission line 28. The output RF signal which has been passed through the input switch circuitry, the filter bank assembly 24 and the output switch circuitry 26 is output on transmission line 30. The transmission lines 28 and 30 are parallel to each other, and orthogonal to the stacking direction of the input circuitry, the filter assembly and the output circuitry.

The new switched filter bank architecture illustrated in FIG. 1 is compact in all directions (x, y, z), and provides very high isolation and rejection performance. With stripline shielded filter structures and the new architecture, the filter bank assembly is very cost effective, and has high yield since the filters can be individually built and tested prior to integration into the assembly.

Figure 2:
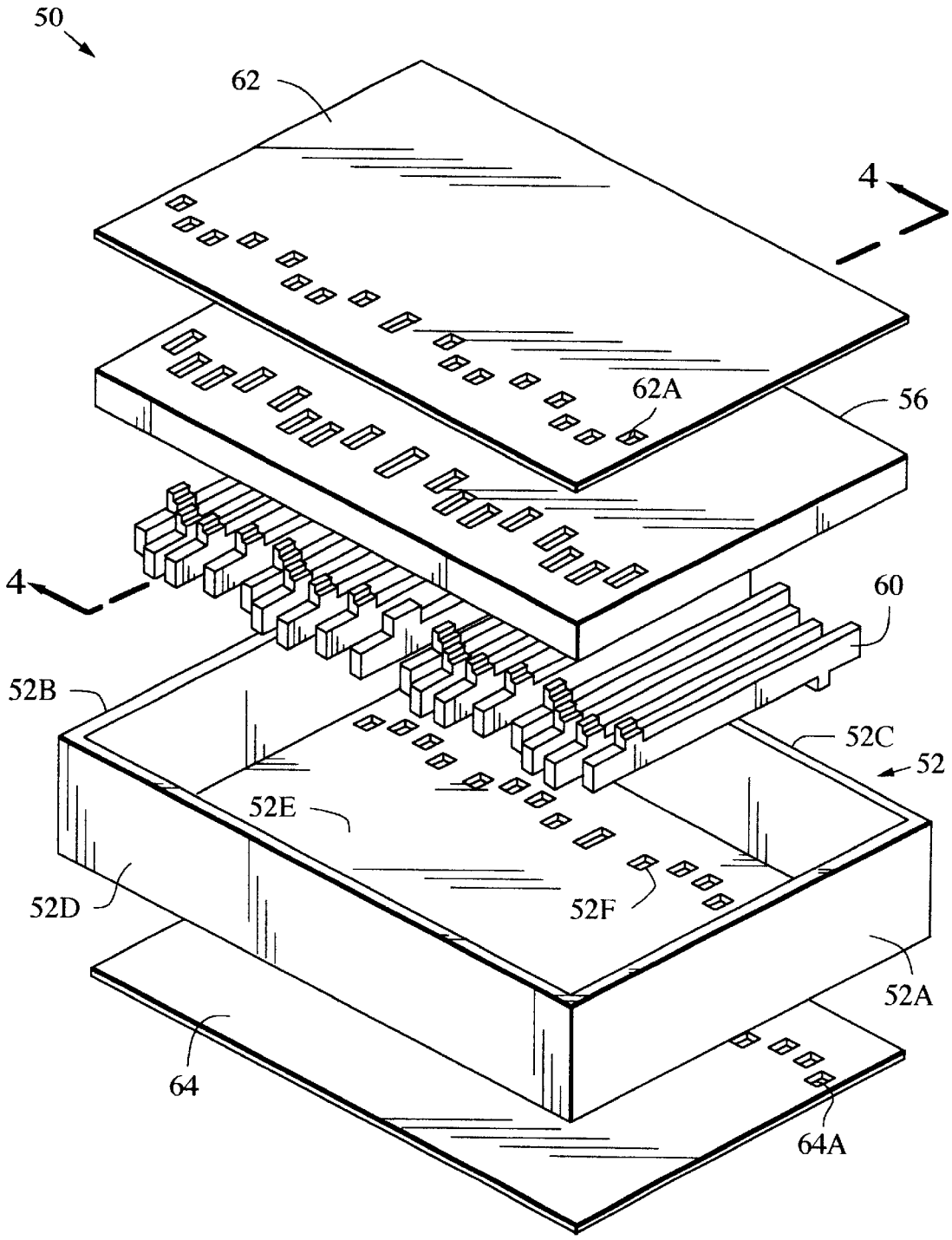
FIG. 2 is an isometric exploded view of a switched filter assembly embodying the invention.
Figure 5:
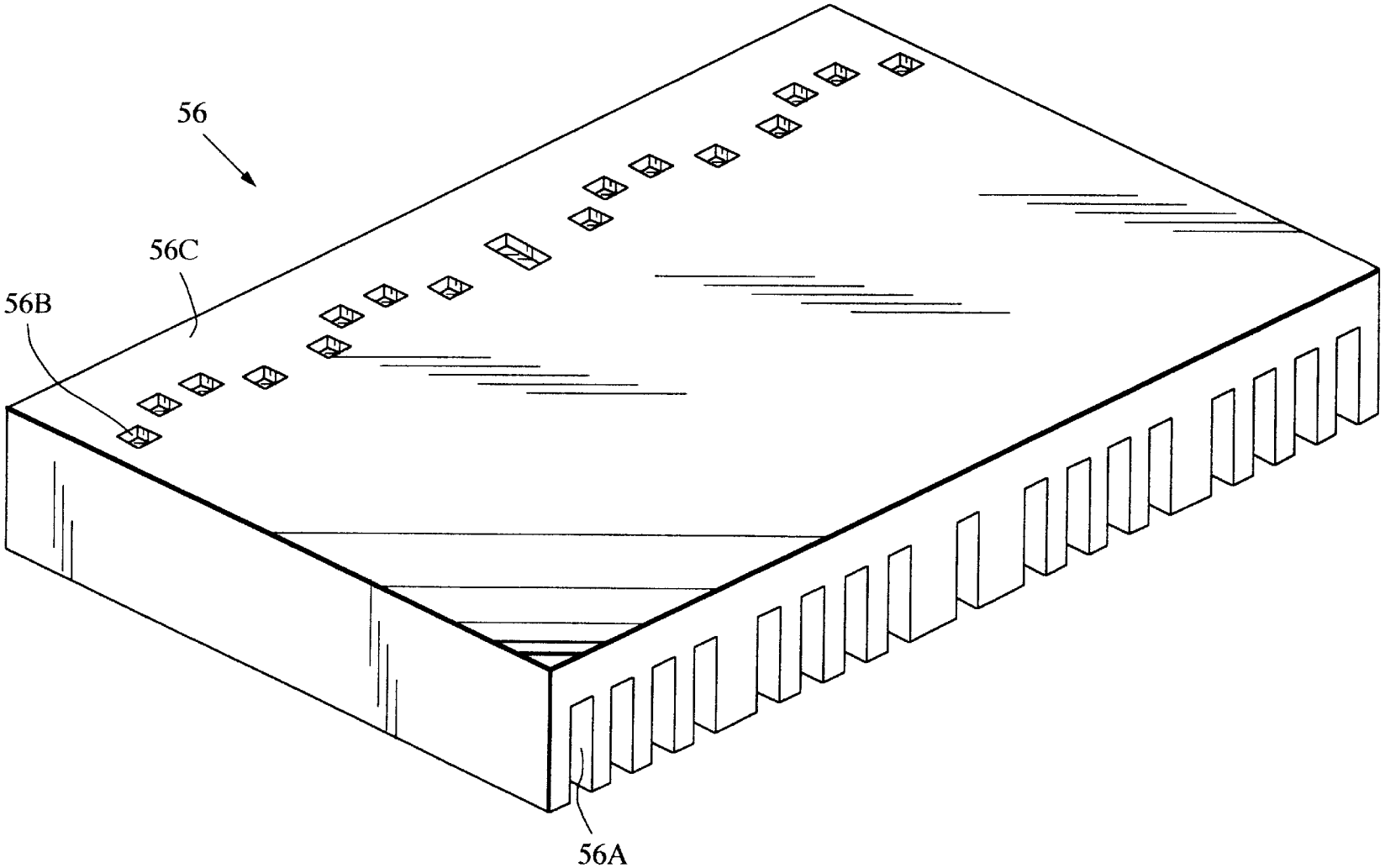
FIG. 5 is an isometric view of the rack structure comprising the assembly of FIG. 2.

An exemplary embodiment of a switched filter assembly 50 embodying the new architecture is shown in exploded view in FIG. 2. The assembly includes a housing 52 fabricated of a conductive material such as aluminum. The housing includes a rectilinear frame with sidewalls 52A–52D and a floor portion 52E with openings 52F formed therein. The floor portion supports a filter rack 56, shown in isolation in the isometric view of FIG. 4. The rack 56 is a metallic structure, which can be fabricated from a solid block of aluminum or other metal, with a plurality of slots 56A formed therein, with each slot communicating with an opening 56B formed in the top surface 56C of the rack.

The assembly 50 further includes a plurality of filters 60, each fitted into corresponding ones of the slots 56A formed in the rack. The rack therefore provides structural support to the filters 60, holding the filters in alignment and providing grounding for the filters in the assembly.

The assembly includes top and bottom dielectric substrates or motherboards 62 and 64. In an exemplary embodiment, the substrates are 0.015 inch in thickness, and are fabricated of a material such as alumina. The substrates typically have conductive circuit traces and pads, and passive/active circuit components. The respective substrates 62, 64 have formed therein rectangular openings 62A, 64A at appropriate spacings to receive therethrough portions of the filters 60 as well as control and power carrying substrates.

In accordance with an aspect of the invention, the Input switch circuitry 22 for the filter assembly is disposed on one mother board assembly, say mother board 62, and all the output switch circuitry 26 is disposed on the second of the mother board assemblies, mother board 64. The microwave filter functions are located within the housing structure. Control signals and dc power signals are passed between the upper and lower mother board structures using special substrates, described in further detail on co-pending commonly assigned application Ser. No. 09/532,264, entitled COMPACT Z-AXIS DC AND CONTROL SIGNALS ROUTING SUBSTRATE, the entire contents of which are incorporated herein by this reference.

Figure 3:
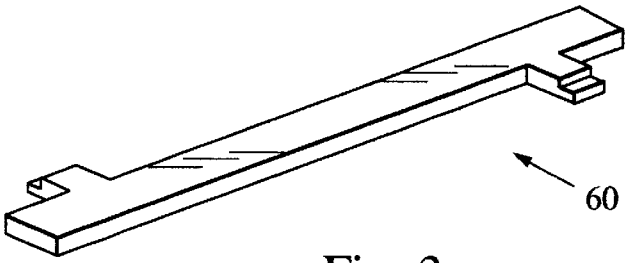
FIG. 3 is a simplified isometric view of a single low profile stripline filter comprising the assembly of FIG. 2.

FIG. 3 is an isometric view of an exemplary one of the sixteen low profile stripline filters 60 comprising the exemplary switched filter assembly of FIG. 2. In this exemplary embodiment, the stripline filters are each fabricated on an alumina substrate 0.030 inch in thickness. Using a well known thick film process, a conductive layer, e.g. gold, is plated on all sides of the substrate except the input/output areas for grounding and shielding. At interface edges, the traces have 0.01 inch by 0.005 inch signal and ground pads, facilitating connection using wire bonds to the switching circuitry and to ground, and on the mother boards. The filter assemblies are sandwiched between the two mother boards using the positioning rack.

Figure 4:
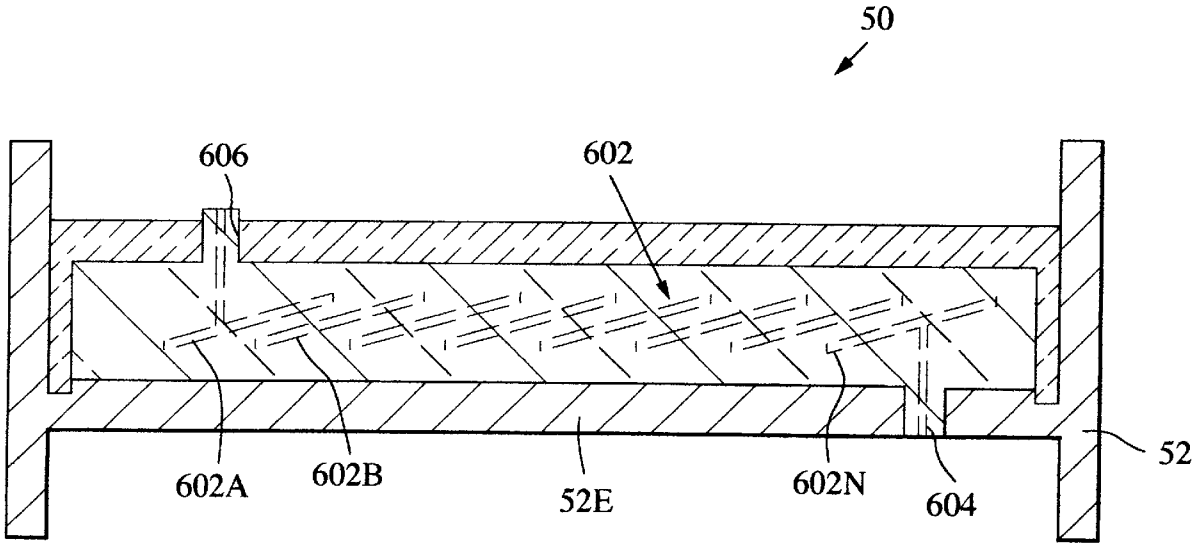
FIG. 4 is a cross-sectional view taken along line 4—4 of FIG. 2.

FIG. 4 is a cross-sectional view taken along line 4—4 of FIG. 2, showing the filter 60 in further detail. A conductive trace pattern 602 is sandwiched between two planar dielectric substrates, by forming the pattern on one substrate surface and positioning the second substrate against the pattern bearing surface. The pattern 602 is formed of input/output (I/O) traces 604, 606, with a series of spaced, angled traces 602A, 602B . . . 602N disposed between the I/O traces. The spacing/number of the angled traces determines the passband of the particular filter. In this exemplary embodiment, the filter passbands are in the X-band range, although other frequency ranges can alternatively be employed.

Figure 6:
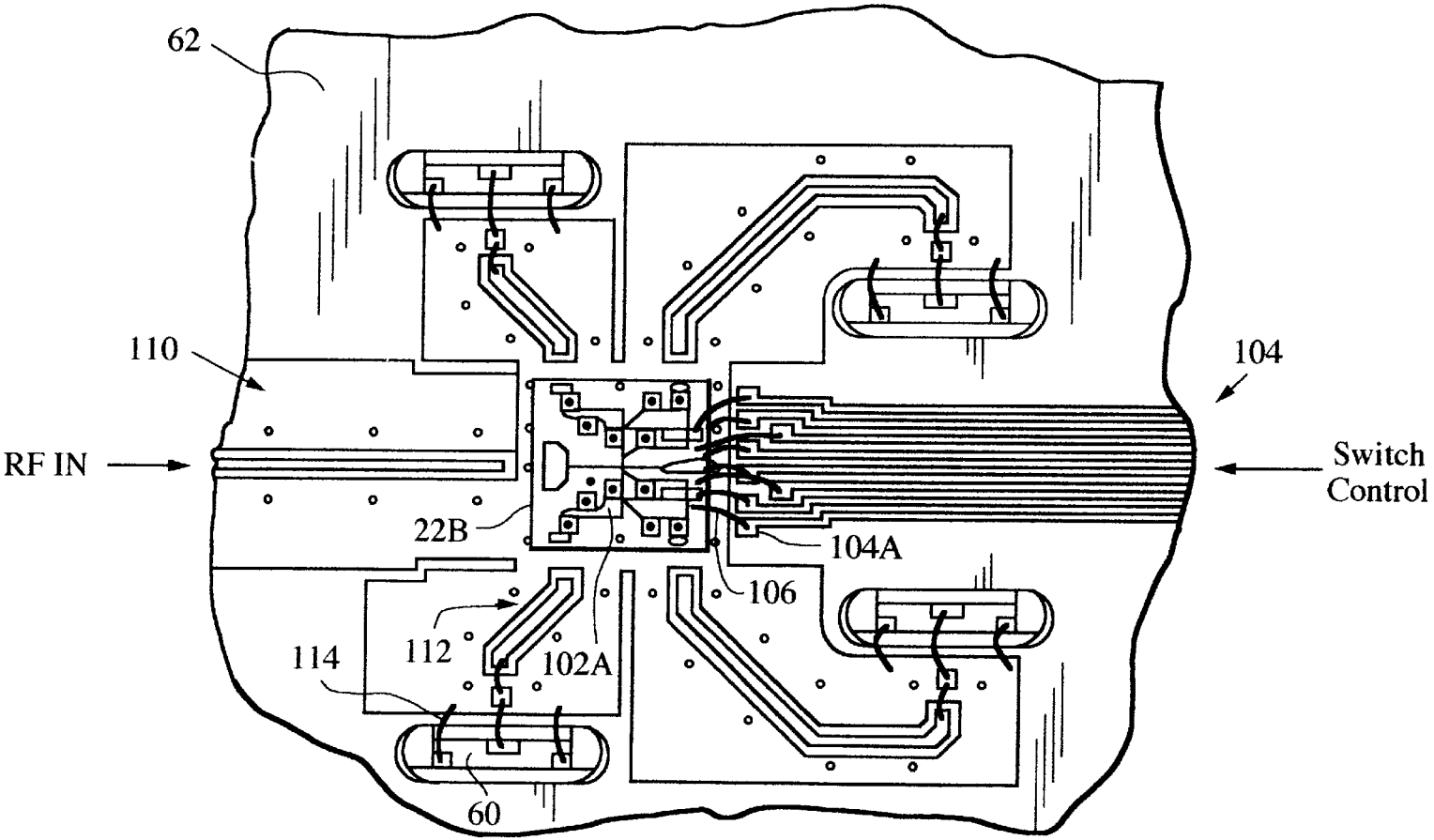
FIG. 6 is a top view illustrating a portion of the top mother board of the assembly of FIG. 2, showing several filter-to-mother board transitions and a switch MMIC.

Once the assembly of the filters, rack and mother boards has been made, the filters 60 are connected to the top and bottom switching circuits using wire bonds. The I/O pads of the filters appear through the slots formed in the top and bottom mother boards, as shown in FIG. 6. FIG. 6 is a top view illustrating a portion of the top mother board 62 of the assembly of FIG. 2, showing four of sixteen filter-to-mother board transitions and a switch microwave monolithic integrated circuit (MMIC). Thus, the input switch circuit 22 includes, for this exemplary embodiment, four single-pole-4-throw (SP4T) switch MMICs, including switch MMIC 22B. The input switch circuit further includes switch control lines 104 for providing switch control signals to the switch MMIC 22B. The lines 104 are fabricated as conductive traces formed on the top surface of the mother board 62, and wire bond connections 106 are provided between trace pads 104A and conductive pads 102A comprising the switch MMIC. An RF transmission line 110 is also fabricated on the mother board 62. RF transmission lines 112 run from the switch MMIC 22B to areas adjacent the I/O area for each filter. The RF transmission lines can for example be fabricated as coplanar waveguide (CPW) transmission lines or microstrip transmission lines. Wire bond connections 114 provide RF interconnections between lines 112 and the I/O pads for the filters 60.

The switch control signals enable the RF input signal provided on transmission line 112 to be coupled to a selected one of the three filters 120, 121, 122 connected to the switch MMIC. This allows the filter passband to which the input signal is passed through to be selected.

Figure 7:
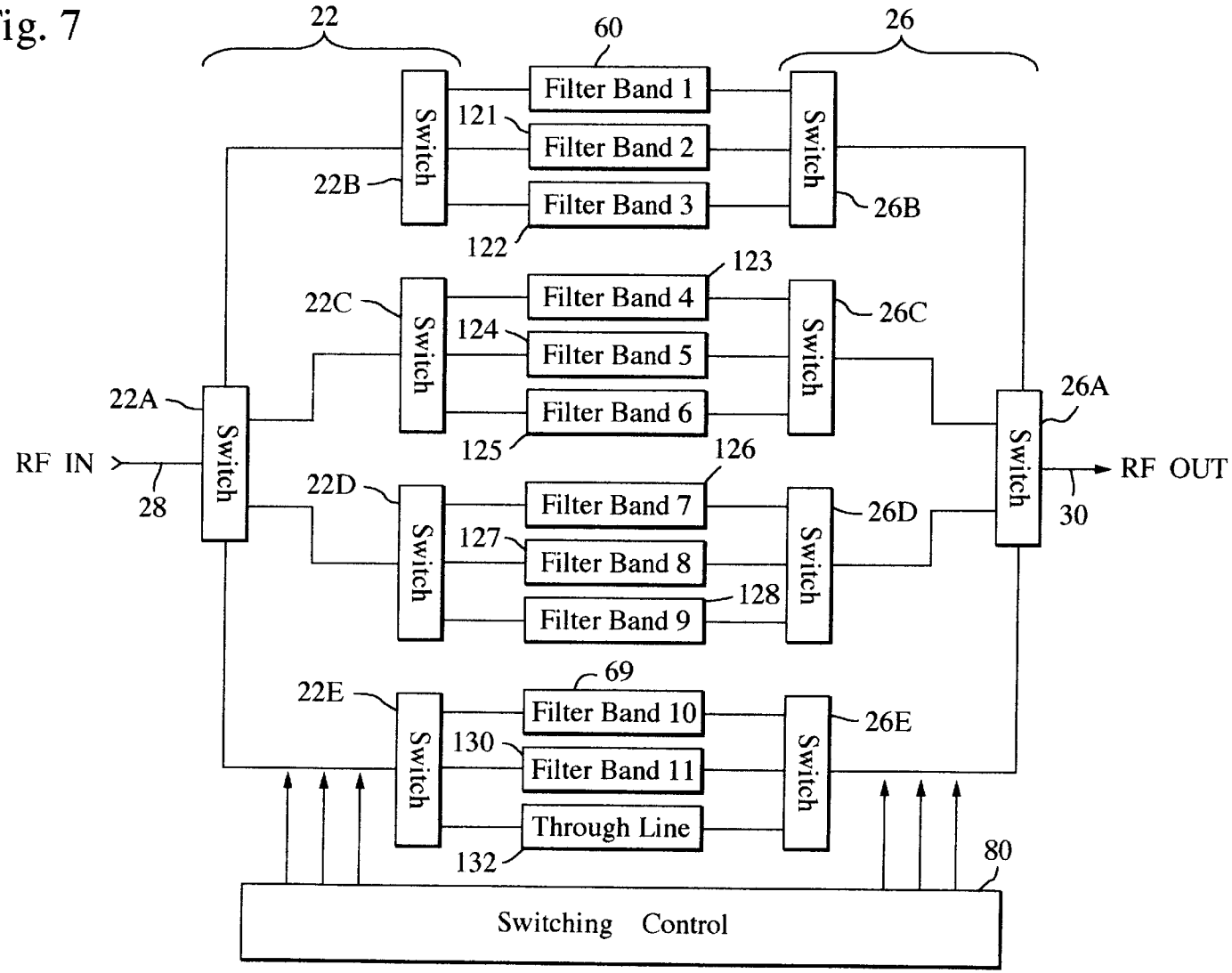
FIG. 7 is a simplified schematic diagram of an exemplary switched filter circuit assembly in accordance with an aspect of the invention.

FIG. 7 is a simplified schematic diagram of an exemplary switched filter circuit assembly in accordance with an aspect of the invention. The input switch circuit 22 includes a single pole, 4-throw switch 22A, with its outputs connected to respective inputs of the four single pole, 4-throw MMIC switches 22B–22E. Thus, by appropriate control of the respective switches by the switching control 80, an RF input signal 28 can be directed to a desired one of the eleven filters 120–130 shown in FIG. 7 or to the through line 132.

The output switch circuit 26 is analogous to the input switch circuit 22, with switches 26A–26E. The output switch circuit 26 will be set by switching control 80 in synchronism with the input switch circuit 22 so that the output from the desired one of the filters or through line is routed to the RF signal output line 30.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A multi-channel microwave switched filter bank, comprising:

an input RF signal line and an output RF signal line;

a filter bank of RF filter circuits mounted in a housing, wherein the housing comprises an output peripheral frame structure having an electrically conductive surface;

an input switch circuit electrically connected between the input RF signal line and the filter bank to direct an input signal to an input of a selected one of said RF filters;

an output switch circuit electrically connected between the filter bank and the output RF signal line to selectively connect an output of the selected one of the RF filters to the output RF signal line;

a rack structure having a plurality of elongated slots formed therein for mounting therein corresponding ones of the plurality of filter circuits, said rack structure disposed within said peripheral frame structure, said rack structure fabricated of an electrically conductive material to provide isolation between said RF filter circuits;

a first dielectric substrate board mounted adjacent a first one of said opposite sides of the filter bank, and a second dielectric substrate board mounted adjacent a second one of said opposite sides of the filter bank, and wherein said input switch circuit is mounted to said first dielectric substrate, and said output switch circuit is mounted to said second dielectric substrate; and wherein the input switch circuit and the output switch circuit are mounted on opposite sides of the filter bank, providing a compact structure.

2. The switched filter bank of claim 1 wherein said frame structure has a planar conductive floor portion, said first dielectric substrate is mounted adjacent a planar surface of said rack structure, and said second dielectric substrate is mounted adjacent said floor portion in a generally parallel configuration.

3. The switched filter bank of claim 2 wherein said first dielectric structure has formed thereon said input RF signal line, and said second dielectric structure has formed thereon said output RF signal line.

4. The switched filter bank of claim 1 further comprising a switching controller for providing commands to the input switch circuit and the output switch circuit for determining said selected one of said RF filters.

5. The switched filter bank of claim 1 further including a through RF signal line selectively connected between the input switch circuit and the output switch circuit.

6. The switched filter bank of claim 1, wherein said RF filter circuits each comprise a low profile stripline filter structure.

7. A multi-channel microwave switched filter bank, comprising:

a plurality of microwave band pass filter circuits;

a housing structure providing an outer conductive peripheral frame structure;

a rack structure having a plurality of elongated slots formed therein for mounting therein corresponding ones of the plurality of filter circuits, said rack structure disposed within said housing structure;

a top dielectric substrate board mounted adjacent a first side of the rack structure and having a first set of openings formed therein for providing access to a first set of input/output (I/O) ports of the plurality of filter circuits;

a bottom dielectric substrate board mounted adjacent a second side of the rack structure opposite said first side and having a second set of openings formed therein for providing access to a second set of input/output (I/O) ports of the plurality of filter circuits;

a first switch circuit mounted to said top dielectric substrate board for selecting one or more filter channels for connection to a first RF transmission line;

a second switch circuit mounted to said bottom dielectric substrate board for selecting one or more filter channels for connection to a second RF transmission line.

8. The switched filter bank of claim 7, wherein said frame structure has a planar conductive floor portion, said first dielectric substrate is mounted adjacent a planar surface of said rack structure, and said second dielectric substrate is mounted adjacent said floor portion in a generally parallel configuration.

9. The switched filter bank of claim 8 wherein said first dielectric structure has formed thereon said input RF signal line, and said second dielectric structure has formed thereon said output RF signal line.

10. The switched filter bank of claim 7 further comprising a switching controller for providing commands to the input switch circuit and the output switch circuit for determining said selected one of said RF filters.

11. The switched filter bank of claim 7 further including a through RF signal line selectively connected between the input switch circuit and the output switch circuit.

12. The switched filter bank of claim 7, wherein said RF filter circuits each comprise a low profile stripline filter structure.

* * * * *